US012276010B2

(12) United States Patent
Wang et al.

(10) Patent No.: US 12,276,010 B2
(45) Date of Patent: Apr. 15, 2025

(54) ALUMINUM ALLOY FOR HIGH PRESSURE DIE CASTING OF ULTRA-LARGE VEHICLE BODY STRUCTURES

(71) Applicant: GM Global Technology Operations LLC, Detroit, MI (US)

(72) Inventors: Qigui Wang, Rochester Hills, MI (US); Liang Wang, Rochester Hills, MI (US); Daniel J. Wilson, Linden, MI (US); Dale A. Gerard, Bloomfield Hills, MI (US); Devin R. Hess, Clarkston, MI (US); Paul Boone, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 112 days.

(21) Appl. No.: 18/064,980

(22) Filed: Dec. 13, 2022

(65) Prior Publication Data

US 2024/0191326 A1 Jun. 13, 2024

(51) Int. Cl.

| | |
|---|---|
| ***C22C 21/02*** | (2006.01) |
| ***B22D 17/00*** | (2006.01) |
| ***B22D 21/00*** | (2006.01) |
| *C22F 1/043* | (2006.01) |

(52) U.S. Cl.
CPC ..... *C22C 21/02* (2013.01); *B22D 17/00* (2013.01); *B22D 21/007* (2013.01)

(58) Field of Classification Search
CPC ..... C22C 21/02; C22C 21/04; C22F 1/043
See application file for complete search history.

(56) References Cited

U.S. PATENT DOCUMENTS

2012/0000578 A1* 1/2012 Wang ..... C22C 21/04 164/47
2018/0010214 A1* 1/2018 Wang ..... C22C 21/02

FOREIGN PATENT DOCUMENTS

CN 115261684 A * 11/2022 ..... C22C 1/026

* cited by examiner

*Primary Examiner* — Lois L Zheng
(74) *Attorney, Agent, or Firm* — Vivacqua Crane, PLLC

(57) ABSTRACT

An aluminum alloy for high pressure die casting of ultra-large vehicle body structures. The aluminum alloy includes about 4.00 to about 12.00 weight percent silicon (Si); about 0.20 weight percent maximum (Max) copper (Cu); about 0.40 weight percent Max magnesium (Mg); about 0.20 to about 0.60 weight percent iron (Fe); about 1.00 weight percent Max manganese (Mn); about 0.50 weight percent Max zinc (Zn); about 0.02 weight percent Max strontium (Sr); about 0.50 weight percent Max cerium (Ce); about 0.01 weight Max percent boron (B); and a remaining weight percent aluminum (Al). The aluminum alloy provides an as-cast yield strength of greater than 130 Megapascals (MPa), ultimate tensile strength of greater than 260 MPa, and elongation of greater than 6% without the need for heat treatment.

20 Claims, 9 Drawing Sheets

| Element | Weight Percentage (wt%) | Preferred wt% |
|---|---|---|
| Silicon (Si) | 4.00 to 12.00 | 6.00 to 8.000 |
| Copper (Cu) | 0.00 to 0.20 | > 0.00 to 0.150 |
| Magnesium (Mg) | 0.00 to 0.40 | > 0.00 to 0.300 |
| Iron (Fe) | 0.20 to 0.60 | 0.20 to 0.500 |
| Manganese (Mn) | 0.00 to 1.00 | > 0.00 to 0.500 |
| Zinc (Zn) | 0.00 to 0.50 | > 0.00 to 0.200 |
| Strontium (Sr) | 0.00 to 0.02 | > 0.00 to 0.015 |
| Cerium (Ce) | 0.00 to 0.50 | > 0.00 to 0.300 |
| Boron (B) | 0.00 to 0.01 | > 0.00 to 0.008 |
| Aluminum (Al) | Remainder | Remainder |

Table A

| Alloy | Si | Mg | Fe | Mn | Cu | Zn | Sr | Ce/La | | YS(MPa) | UTS(MPa) | Elongation (%) |
|---|---|---|---|---|---|---|---|---|---|---|---|---|
| #1 | 7.1 | 0.29 | 0.45 | 0.25 | 0.15 | 0.15 | 0.011 | | As-cast | 143±5 | 274±10 | 7.8±1.0 |
| #2 | 6.9 | 0.28 | 0.44 | 0.21 | 0.18 | 0.15 | 0.01 | 0.2 | | 145±6 | 280±11 | 8.9±1.1 |
| #3 | 6 | 0.3 | 0.45 | 0.23 | 0.15 | 0.15 | 0.009 | | | 135±4 | 272±9 | 10.5±1.3 |
| #4 | 5.9 | 0.329 | 0.43 | 0.22 | 0.15 | 0.15 | 0.009 | 0.2 | | 138±4 | 270±8 | 11.5±1.3 |

FIG. 9

| Alloys* | Si (%) | Mg (%) | Fe (%) | Mn (%) | Ni (%) | Zn (%) | Cu (%) | Sr (%) | AS-Cast | | | T5 | | |
|---|---|---|---|---|---|---|---|---|---|---|---|---|---|---|
| | | | | | | | | | $\sigma_{0.2}$ (MPa) | UTS (MPa) | Strain (%) | $\sigma_{0.2}$ (MPa) | UTS (MPa) | Strain (%) |
| Exp. #5 | 8.3 | 0.11 | 0.93 | 0.43 | 0.45 | 1.9 | 3.4 | <0.001 | 143.61 | 187.78 | 0.72 | 182.20 | 185.68 | 0.43 |
| Exp. #6 | 10.9 | 0.37 | 1.1 | 0.98 | 0.51 | 2 | <0.01 | 0.015 | 132.87 | 171.88 | 0.62 | 196.00 | 205.30 | 0.41 |
| Exp. #7 | 11.1 | 0.4 | 1.1 | 0.78 | 0.51 | 2 | <0.01 | <0.01 | 140.90 | 156.80 | 0.49 | 183.46 | 188.18 | 0.32 |
| Exp. #8 | 11.1 | 0.44 | 1.1 | 0.73 | 0.5 | 2 | <0.01 | 0.015 | 143.35 | 172.92 | 0.60 | 194.08 | 196.58 | 0.34 |

* Note: The tensile samples were made in a PM mold with a gauge diameter of 12.7 mm.

FIG. 10

ALUMINUM ALLOY FOR HIGH PRESSURE DIE CASTING OF ULTRA-LARGE VEHICLE BODY STRUCTURES

INTRODUCTION

The present disclosure relates to aluminum die casting alloys, more particularly, to an aluminum alloy for high pressure die casting of ultra-large vehicle body structures.

High pressure die casting is a metal casting process that is characterized by forcing molten metal under high pressure into a mold cavity having a predetermined shape. Modern vehicles, especially those of hybrid and electric vehicles, are moving toward simpler vehicle body designs by die casting ultra-large single-piece panels and components that may serve as load bearing structures of the vehicle body. These ultra-large single-piece castings are often referred to as mega-castings or giga-castings due to the huge size of the die casting machines used to make these castings. Ultra-large castings allow vehicle bodies to be lighter and less complex to manufacture by replacing the large number of stamped panels and components required to form the vehicle body with an ultra-large single-piece casting. As an example, an ultra-large single-piece casting can have a width of at least 0.8 meter (m), a length of at least 1 m, and a height of at least 0.25 m.

Aluminum-silicon (Al—Si) based alloys are typically used in die casting of vehicle body structures due to the alloys' lightweight, superior moldability, mass producibility, and high strength. In Al—Si casting alloys (e.g., alloys 319, 356, 390, 360, 380), strengthening is achieved through heat treatment after casting. Heat treatment generally includes at least one or a combination of three steps: (1) solution treatment at a relatively high temperature below the melting point of the alloy, often for times exceeding 8 hours or more to dissolve its alloying elements and to homogenize or modify the microstructure; (2) rapid cooling, or quenching into a cold or warm liquid medium after solution treatment, such as water, to retain the solute elements in a supersaturated solid solution; and (3) artificial aging, also referred to as T5, by holding the alloy for a period of time at an intermediate temperature suitable for achieving hardening or strengthening through precipitation. While heat treatment increases the strength of the castings, it does so at the expense of ductility.

Thus, while known Al—Si alloys for die casting ultra-large vehicle structures achieve their intended purpose, there is a continual need for development of aluminium alloys for predictable and desired mechanical properties while improving performance and environmentally sustainability.

SUMMARY

According to several aspects, an aluminum alloy suitable for high pressure die casting of ultra-large vehicle body structures is disclosed. The aluminum alloy includes about 4 to about 12 weight percent (wt %) silicon (Si); greater than 0 wt % to about 0.4 wt % magnesium (Mg); about 0.2 wt % to about 0.6 wt % iron (Fe); greater than 0 wt % to about 1 wt % manganese (Mn); greater than 0 wt % to about 0.02 wt % strontium (Sr); and a remainder wt % of aluminum (Al).

In an additional aspect of the present disclosure, the aluminum alloy further includes one or more of: greater than 0 wt % to about 0.5 wt % cerium (Ce); greater than 0 wt % to about 0.01 wt % boron (B); greater than 0 wt % to about 0.20 wt % copper (Cu); and greater than 0 wt % to about 0.5 wt % zinc (Zn).

In another aspect of the present disclosure, the aluminum alloy includes preferably about 6 to about 8 weight wt % Si; greater than 0 wt % to about 0.3 wt % Mg; about 0.2 wt % to about 0.5 wt % Fe; greater than 0 wt % to about 0.5 wt % Mn; and greater than 0 wt % to about 0.015 wt % Sr.

In another aspect of the present disclosure, the aluminum alloy further includes preferably one or more of: greater than 0 wt % to about 0.3 wt % Ce; greater than 0 wt % to about 0.008 wt % B; greater than 0 wt % to about 0.15 wt % Cu; and greater than 0 wt % to about 0.2 wt % Zn.

In another aspect of the present disclosure, the aluminum alloy is a secondary aluminum alloy.

According to several aspects, an ultra-large high pressure die casting is disclosed. The casting includes about 4 to about 12 weight percent (wt %) silicon (Si); greater than 0 wt % to about 0.20 wt % copper (Cu); greater than 0 wt % to about 0.4 wt % magnesium (Mg); about 0.2 wt % to about 0.6 wt % iron (Fe); greater than 0 wt % to about 1 wt % manganese (Mn); 0 wt % to about 0.5 wt % zinc (Zn); greater than 0 wt % to about 0.02 wt % strontium (Sr); greater than 0 wt % to about 0.5 wt % cerium (Ce); greater than 0 wt % to about 0.01 wt % boron (B); and a remainder wt % of aluminum (Al).

In an additional aspect of the present disclosure, the ultra-large high pressure die casting includes an as-cast elongation of greater than 6%, an as-cast yield strength of greater than 130 Megapascals (MPa), and an as-cast ultimate tensile strength of greater than 260 Megapascals (MPa).

In another aspect of the present disclosure, the ultra-large high pressure die casting includes preferably about 6 to about 8 weight percent (wt %) silicon (Si); greater than 0 wt % to about 0.20 wt % copper (Cu); greater than 0 wt % to about 0.4 wt % magnesium (Mg); about 0.2 wt % to about 0.6 wt % iron (Fe); greater than 0 wt % to about 1 wt % manganese (Mn); greater than 0 wt % to about 0.5 wt % zinc (Zn); greater than 0 wt % to about 0.02 wt % strontium (Sr); greater than 0 wt % to about 0.5 wt % cerium (Ce); greater than 0 wt % to about 0.008 wt % boron (B); and a balance of Aluminum (Al)

In another aspect of the present disclosure, the ultra-large high pressure die casting is cast with a secondary aluminum casting alloy.

In another aspect of the present disclosure, the ultra-large high pressure die casting includes a length greater than 2 meters, a width greater than 0.8 meter, and a height of greater than 0.25 meter.

In another aspect of the present disclosure, the ultra-large high pressure die casting includes a maximum wt % of Mg as expressed by the equation: $Mg(max)=0.5568Exp(-3.128 \cdot Fe\ wt\ \%)$.

According to several aspects, a secondary aluminum alloy suitable for high pressure die casting of ultra-large structures is disclosed. The secondary aluminum alloy includes about 4 to about 12 weight percent (wt %) silicon (Si); about 0.2 wt % to about 0.6 wt % iron (Fe); greater than 0 wt % to about 1 wt % manganese (Mn); greater than 0 wt % to about 0.02 wt % strontium (Sr); greater than 0 wt % to about 0.20 wt % copper (Cu); greater than 0 wt % to about 0.5 wt % zinc (Zn); and a remainder wt % of aluminum (Al). The secondary aluminum alloy is manufactured from at least one recycled aluminum alloy.

In an additional aspect of the present disclosure, the secondary aluminum alloy includes greater than 0 wt % to about 0.4 wt % magnesium (Mg).

In an additional aspect of the present disclosure, the secondary aluminum alloy includes a weight percentage of Mg as expressed in the equation: Mg(max)=0.5568Exp (−3.128*Fe wt %).

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

FIG. 9 is a table showing laboratory test data of mechanical properties of as-cast samples of the new aluminum alloy; and FIG. 10 is a table showing laboratory test data of mechanical properties of as-cast samples and heat-treated samples of aluminum alloys having compositions outside the recited ranges of the new aluminum alloy.

DETAILED DESCRIPTION

The following description is merely exemplary in nature and is not intended to limit the present disclosure, application, or uses. The illustrated embodiments are disclosed with reference to the drawings, wherein like numerals indicate corresponding parts throughout the several drawings. The figures are not necessarily to scale, and some features may be exaggerated or minimized to show details of particular features. The specific structural and functional details disclosed are not intended to be interpreted as limiting, but as a representative basis for teaching one skilled in the art as to how to practice the disclosed concepts.

As used herein, "castings" refer generally to aluminum alloy high pressure die castings formed through solidification of aluminum alloy compositions.

As used herein, "as-cast" refers generally to solidified aluminum alloy castings ejected from the die-mold without further heat treatment.

As used herein, "mechanical property" refers generally to at least one and/or any combination of, strength, hardness, toughness, elasticity, plasticity, brittleness, and ductility and malleability that measures how a metal, such as aluminum and alloys thereof, behaves under a load.

Figure 1:
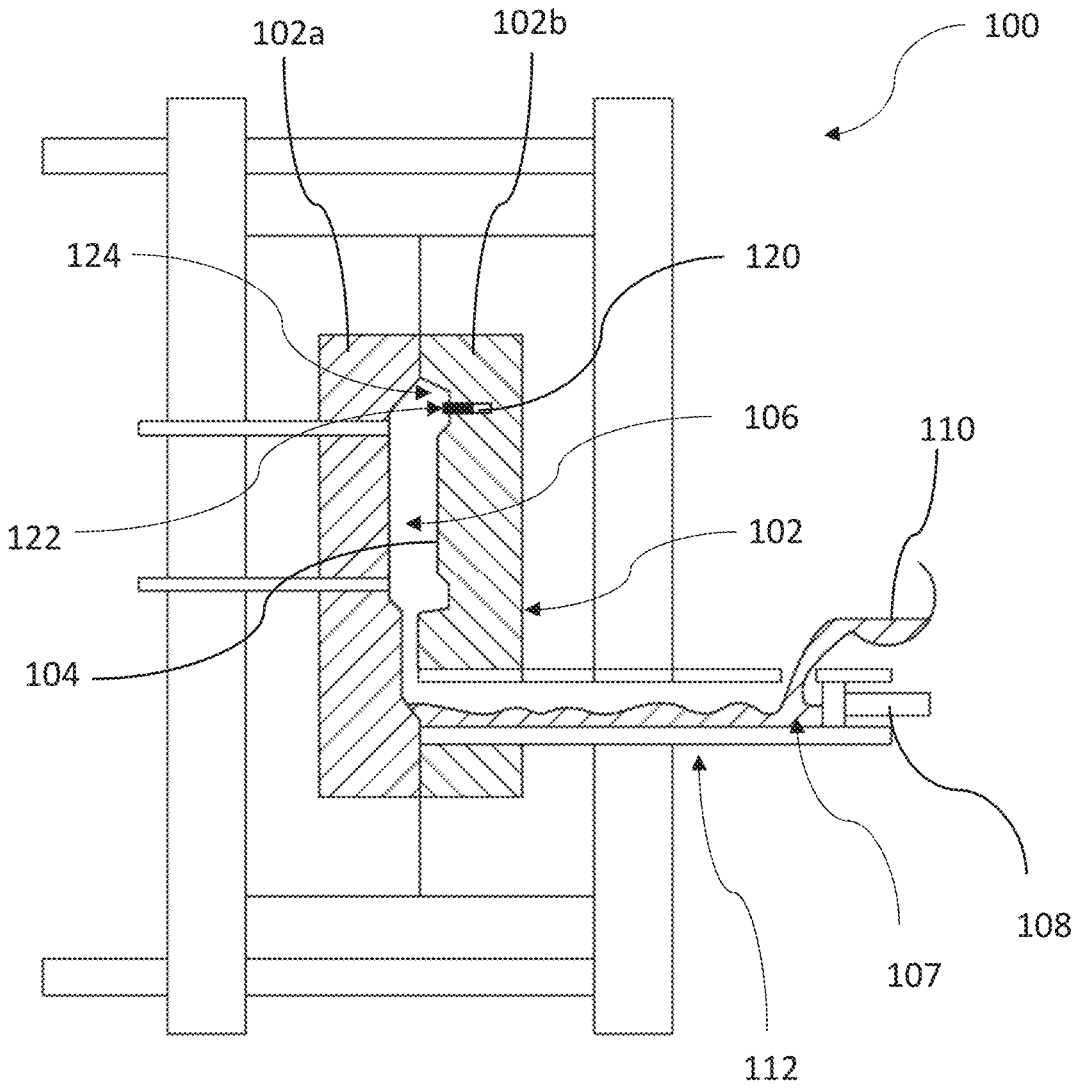
FIG. 1 is a diagrammatic illustration of an exemplary high pressure die casting (HPDC) system, according to an exemplary embodiment.

FIG. 1 shows a diagrammatic illustration of an exemplary high pressure die casting (HPDC) system 500 for manufacturing ultra-large castings of vehicle body structures. The HPDC system 100 includes a die casting mold 102 having an internal surface 104 defining a mold cavity 106. The mold cavity 106 is operable to receive a molten metal 107 to form an ultra-large casting of a vehicle body structure having a predetermined shape of the mold cavity 106. The HPDC system 100 further includes a plunger mechanism 108, a pouring mechanism 110, and a shot sleeve system 112 to provide molten metal to the mold cavity 106.

A molten aluminum-silicon based alloy 107, is introduced into the shot sleeve system 112 and injected by the plunger mechanism 108 into the mold cavity 106. The plunger mechanism 108 is configured to provide a regulated flow of molten metal through the shot sleeve system 112 to fill the mold cavity 106 within a prescribed time and pressure. As an example, the molten metal is injected at a pressure somewhere between 1,500 and 25,000 pounds per square inch (PSI). The die casting mold then maintains this pressure until the metal has solidified. The mold 102 is typically formed of two pieces 102*a*, 102*b*, in which one is a stationary piece 102*a* and the other piece 102*b* is a removable piece to facilitate the removal of the solidified ultra-large casting of the vehicle body structure.

Figures 2, 3:
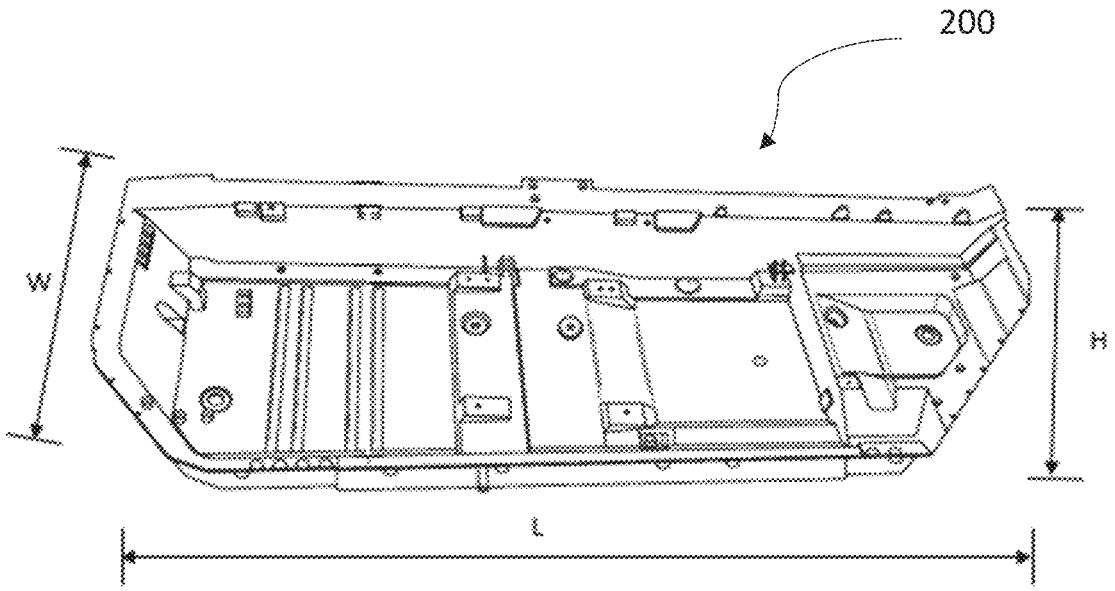
FIG. 2 is an illustration of a perspective view of an ultra-large casting of a vehicle body structure, according to an exemplary embodiment.
FIG. 3 is a table of a new aluminum alloy composition for high pressure die casting of an ultra-large vehicle body structure, according to an exemplary embodiment.

FIG. 2 is a perspective top view of an exemplary ultra-large casting 200 of a vehicle body structure manufacturable by the exemplary HPDC system 100. The vehicle body structure shown is that of a floor pan casting of a vehicle body, also referred to as floor casting 200. The floor casting 200 includes a length (L) of greater than 2 meters (m), a width (W) of greater than 0.8 m, and a height (H) of greater than 0.25 m. The ultra-large castings may be designed and manufactured for use on-road vehicles such as passenger car, motorcycles, trucks, sport utility vehicles (SUVs), recreational vehicles (RVs), and off-road vehicles such as marine vessels and aircrafts. Other examples of such ultra-large vehicle body structures include body panels, battery trays, and other load bearing structures such as trailers for semi-trucks. Mechanical properties such as high yield strength, high ultimate tensile strength, and sufficient ductility are desirable for load bearing vehicle body structures to withstand harsh impacts due to road imperfections and to increase occupant safety in unexpected collisions.

A new aluminum alloy suitable for HPDC processes for casting ultra-large vehicle body structures is disclosed below. The new aluminum alloy, also referred to as the new Al—Si alloy, has desirable properties such as low hot tearing, low shrinkage porosity, and high fluidity conducive for high-pressure die casting; relatively high weight percentage of allowable iron (Fe) and manganese (Mn) contents, thus allowing the use of secondary alloys in the formulation of the new aluminum alloy; and a high potential for dispersion hardening without heat treatment to achieve as-cast mechanical properties of yield strength (YS) greater than 130 Megapascals (MPa), ultimate tensile strength (UTS) greater than 220 MPa, and break elongation, also referred to as elongation, of greater than 6%.

The alloy comprises about 4.00 to about 12.00 weight percent silicon (Si); about 0.20 weight maximum (Max) percent copper (Cu), about 0.40 weight percent Max magnesium (Mg); about 0.20 to about 0.60 weight percent iron (Fe); about 1.00 weight Max percent manganese (Mn); about 0.50 weight percent Max zinc (Zn); about 0.02 weight percent Max strontium (Sr); about 0.50 weight percent Max cerium (Ce); about 0.01 weight percent Max boron (B), and a remaining weight percent aluminum (Al).

Preferably, the new Al—Si alloy comprises about 6.00 to about 8.00 weight percent silicon (Si); greater than 0 to about 0.15 weight percent copper (Cu), greater than 0 to about 0.3 weight percent magnesium (Mg); about 0.20 to about 0.50 weight percent iron (Fe); greater than 0 to about 0.50 weight percent manganese (Mn); greater than 0 to about 0.20 weight percent zinc (Zn); greater than 0 to about 0.015 weight percent strontium (Sr); greater than 0 to about 0.3 weight percent cerium (Ce); greater than 0 to about 0.008 weight percent boron (B), and a remaining weight percent of aluminum (Al).

Shown in FIG. 3 is Table A summarizing the composition of the new Al—Si alloy. In addition to the composition of Si, Cu, Mg, Fe, Mn, Zn, Sr, Ce, B, and Al as recited in Table A, the new Al—Si includes a sludge factor greater than about 0.8 weight percent and less than about 2.0 weight percent, preferably about 0.8 weight percent to about 1.5 weight percent. Sludge factor (SF) is defined by the following equation:

$$\text{Sludge factor}=(1\times\text{wt \% Fe})+(2\times\text{wt \% Mn})+(3\times\text{wt \% Cr})$$

The range of $0.8<SF<2.0$ is effective for avoiding die soldering issue in high pressure die casting process while providing the desired ductility for high pressure die casting of ultra-large vehicle structures.

Iron (Fe) is an impurity commonly found in recycled aluminum alloys, also known as secondary aluminium alloys, and is not normally desirable in Al—Si casting alloys. Even small amounts of iron (Fe) impurities in Al—Si casting alloys may unfavorably affect the desired mechanical properties of the ultra-large castings by forming brittle intermetallic compounds during the solidification phase of the casting process. Intermetallic compounds having Al—Si—Fe needle shape phase significantly adversely affect the ductility of the solidified casting.

The unique composition of the new aluminum alloy allows for a higher weight percentage of iron (Fe), thus enabling the use of secondary aluminium alloys in the formation of the new aluminum alloy. The new aluminum alloy includes a weight percent range of manganese (Mn) sufficient to neutralize the iron (Fe) phase to minimize or avoid the formation of the Al—Si—Fe needle shape phase and to reduce overall Fe-rich intermetallic phases. Castings manufactured of the HPDC process have minimal to no brittle B—Fe phase for high ductility and low density.

The new aluminum alloy includes a weight percent range of strontium (Sr) effective for modifying silicon (Si) morphology from plate shape to fiber shape to increase ductility. Furthermore, the weight percent range of strontium (Sr) is effective to change alloy surface tension to reduce die sticking, also known as soldering, issues.

Figure 4:
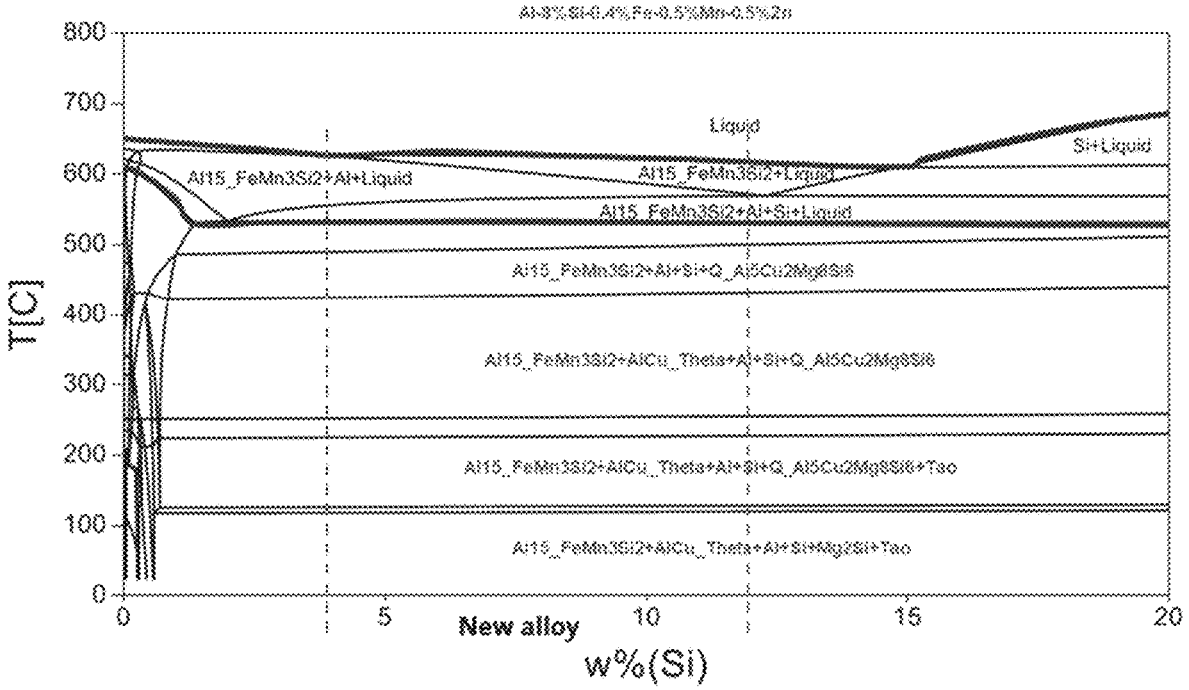
FIG. 4 is a phase diagram of the new aluminum alloy showing phase transformations as a function of silicon (Si) content, according to an exemplary embodiment.

FIG. 4 is a phase diagram of the new aluminum composition showing phase transformations as a function of Si content. The recited Si content provides desirable fluidity for high pressure die casting and low freezing range for the HPDC process.

Figure 5:
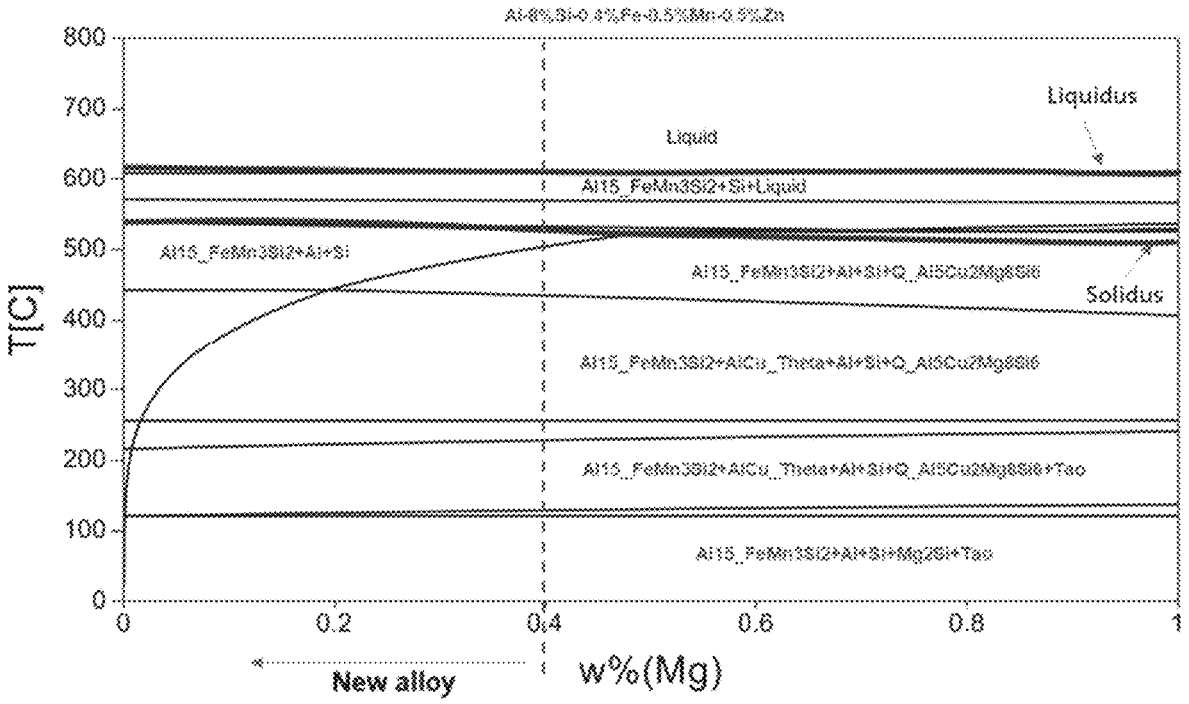
FIG. 5 is a phase diagram of the new aluminum alloy showing phase transformations as a function of magnesium (Mg) content, according to an exemplary embodiment.

FIG. 5 is a phase diagram of the new aluminum composition showing phase transformations as a function of Mg content. The recited Mg content allows for secondary alloys with higher allowable Fe and Mn content to formulate the new aluminum alloy. The recited Mg content provides for low freezing range for good castability and low shrinkage porosity for the HPDC process. The addition of the recited range of Mg content enables the capability and option of natural aging for further improved mechanical properties. In the new aluminium alloy, approximately 0.15-0.20 wt % is expected to be 100% trapped in the Al matrix due to the very fast cooling rate during solidification of the HPDC process.

Figure 6:
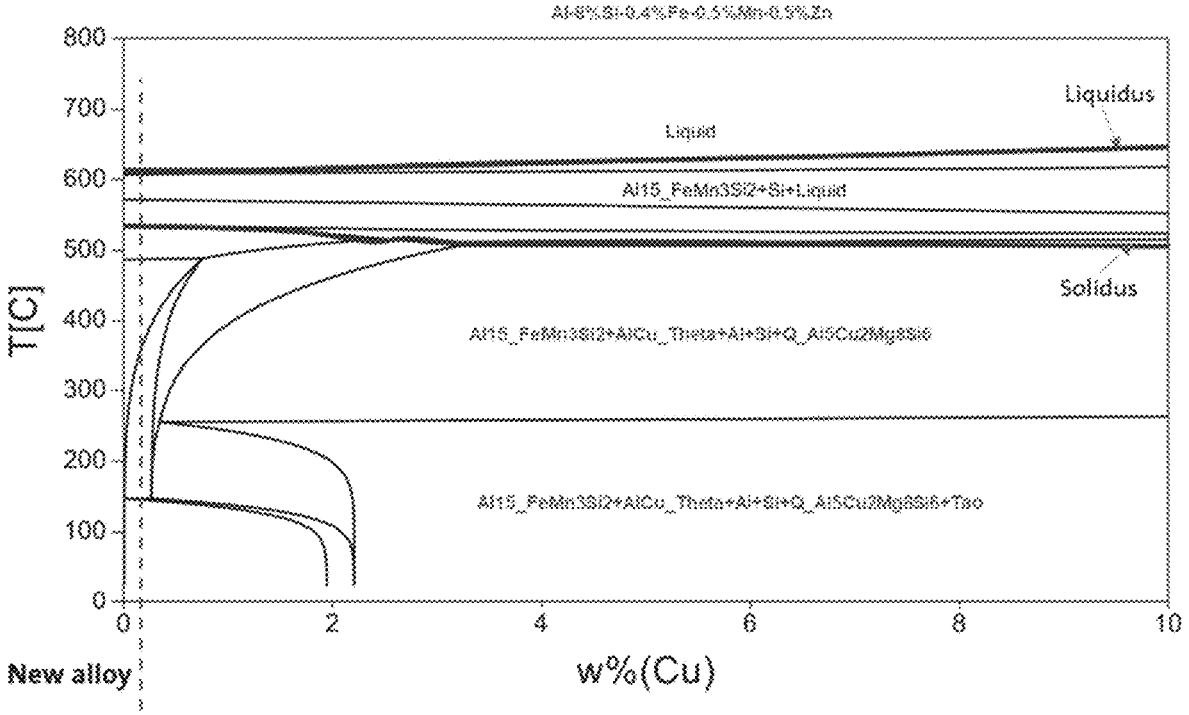
FIG. 6 is a phase diagram of the new aluminum alloy showing phase transformations as a function of copper (Cu) content, according to an exemplary embodiment.

FIG. 6 is a phase diagram of the new aluminum composition showing phase transformations as a function of Cu content. The recited Cu content provides for low freezing range for good castability for the HPDC process. Castings manufactured by the HPDC process have minimal to no brittle B—Fe phase for improved ductility, better corrosion resistance, and potential for natural aging.

Figure 7:
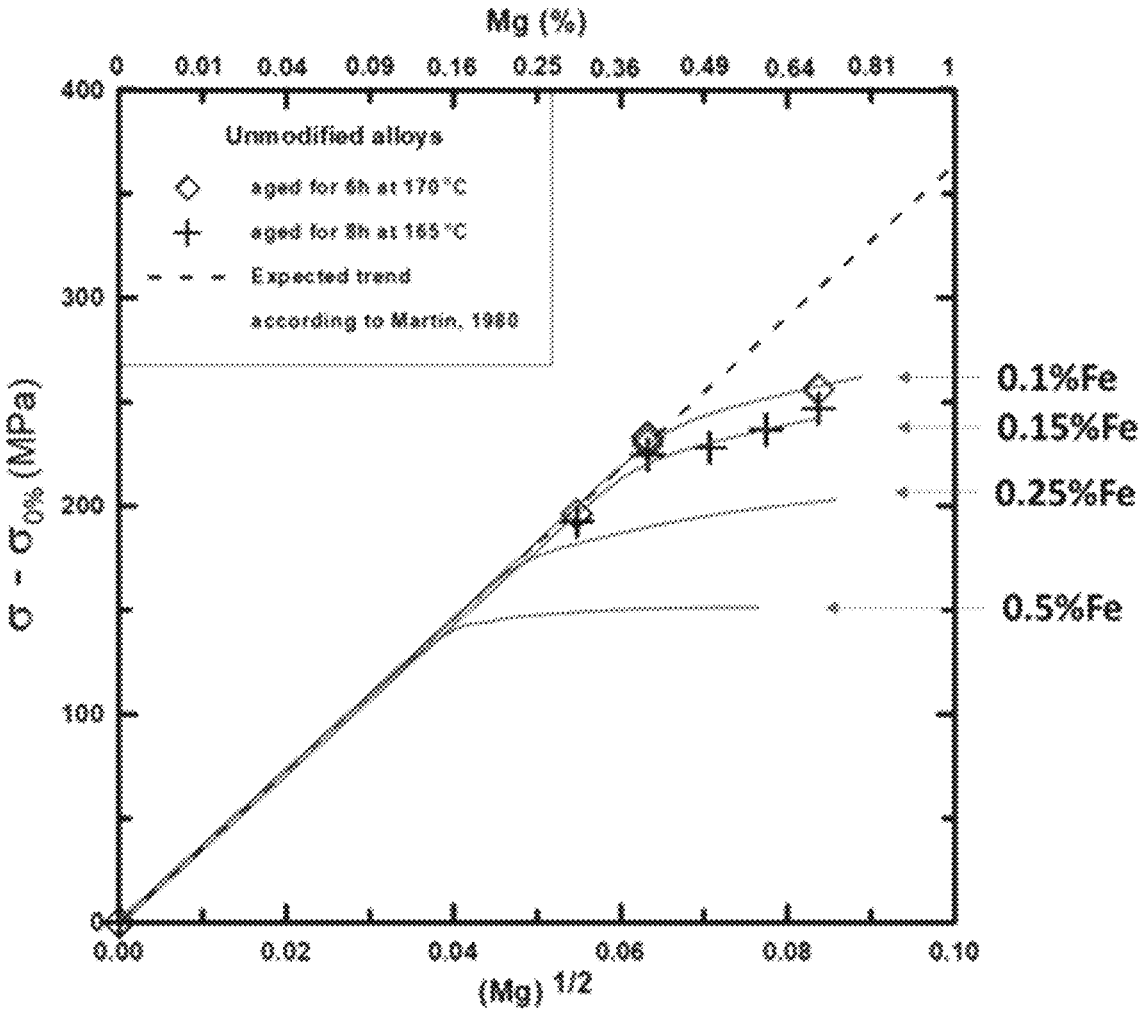
FIG. 7 is a graph comparing the strength of aluminum alloys as function of weight percentages of magnesium (Mg) for given weight percentages of iron (Fe)

FIG. 7 is a graph showing the strength change of unmodified Al—Si alloy as function of weight percentage of magnesium (Mg) for given weight percentages of iron (Fe) as the Fe ties Mg to form Fe—Mg rich intermetallic phases like pi phase ($Al_8FeMg_3Si_6$) when the Mg is higher than a critical content, which is discovered by the inventors. Unmodified, in this instance means the Al—Si alloy does not contain Sr, which is added to modify Si morphology. Mg is added for strengthening in Al—Si based alloy to form Mg/Si nano size precipitates. The addition of Mg also provides the potential and option for further age hardening at a moderate temperature of 150° C. to 200° C. This is advantageous for ultra-large castings that are painted and baked in a paint oven for a predetermined time and temperature for the paint to cure, which is typically about 2 hours at a temperature between 150° C. to 200° C.

Because of the presence of Fe, however, Mg can tie up with Fe to from Fe-rich intermetallic phases, which could adversely affect ductility, particularly when the Mg content is added beyond a maximum effective level for the given Fe content in the alloy. As a result, alloy strength increases linearly with Mg addition until Mg content is close to the maximum effective Mg content.

Figure 8:
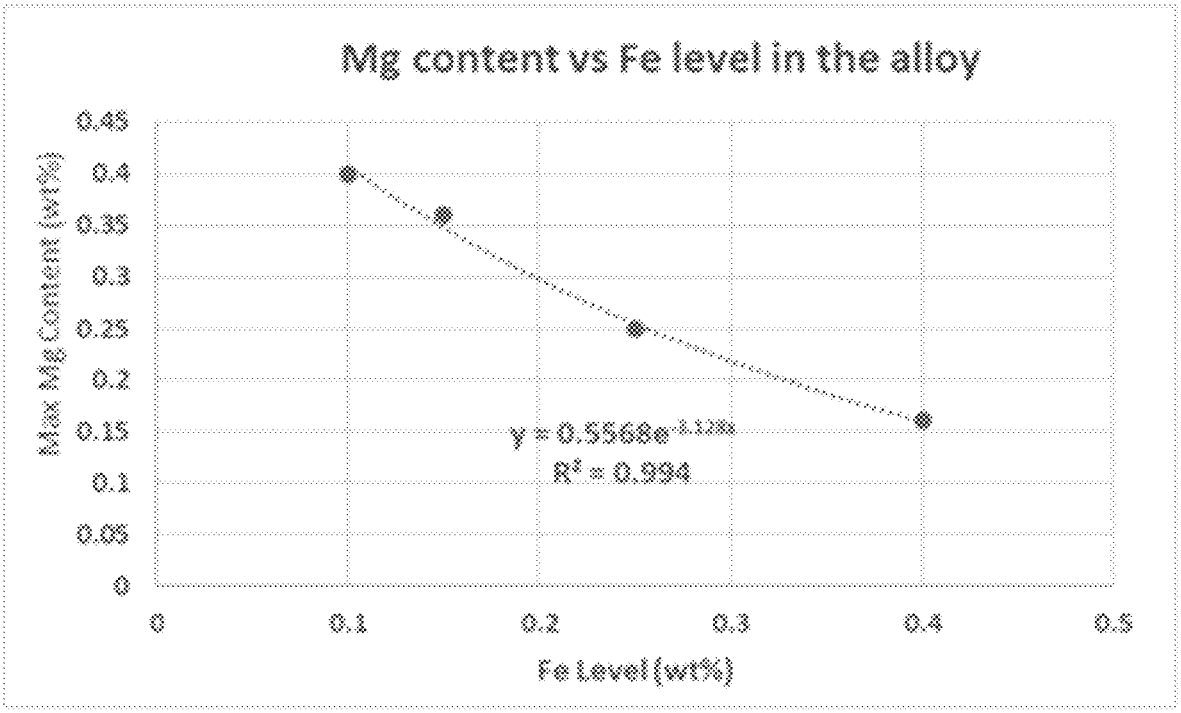
FIG. 8 is a graph showing the maximum effective Mg content (wt %) as a function of Fe content (wt %), according to an exemplary embodiment.

FIG. 8 is a graph showing the maximum Mg content (wt %) as a function of Fe content (wt %) in the new aluminum alloy. An effective amount of Mg is added to the new aluminum alloy for strengthening and to provide a potential for an option of age hardening. Mg content higher than the maximum effective Mg content may have an adverse effect on the desirable ductility of the ultra-large casting. The relation of the maximum effective Mg content for the new aluminum alloy is:

$$Mg(max)=0.5568Exp(-3.128*\text{Fe wt \%})$$

FIG. 9 is a table showing laboratory test data of mechanical properties of as-cast samples of the new aluminum alloy. As-cast means the solidified casting is ejected from the die-cast mold and cooled to room temperature without heat-treatment. Each of the laboratory samples has a yield strength (YS) greater than 130 Megapascals (MPa), ultimate tensile strength (UTS) greater than 220 MPa, and elongation, of greater than 6%. As-cast samples having a yield strength (YS) of greater than 120 MPa and elongation greater than 10%, preferably 12%, are suitable for riveted joint applications. An example of riveted joint application is where an ultra-large vehicle structure is riveted to other ultra-large structures or components.

FIG. 10 is a table showing laboratory test data of mechanical properties of as-cast samples and cast samples after T5 heat treatment of aluminum alloys having compositions of elements outside the recited ranges of the new aluminum alloy. When the alloy compositions are not in the recited ranges of the new aluminum alloy, the castings do not achieve the ductility (>6%) of the new aluminum alloy, even undergoing T5 heat treatment. The low ductility may be the result from one or more of the Si, Fe, Mn, Ni, Zn, or Cu exceeding the recited maximums of the new aluminum alloy.

Numerical data have been presented herein in a range format. The term "about" includes +/−0.05% by weight of the stated value. It is to be understood that this range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. While examples have been described in detail, those familiar with the art to which this disclosure relates will recognize various alternative designs and examples for practicing the disclosed method within the scope of the appended claims.

The description of the present disclosure is merely exemplary in nature and variations that do not depart from the general sense of the present disclosure are intended to be within the scope of the present disclosure. Such variations are not to be regarded as a departure from the spirit and scope of the present disclosure.

What is claimed is:

1. An aluminum alloy suitable for high pressure die casting of vehicle body structures, comprising:
about 5.9 to about 7.1 weight percent (wt %) silicon (Si);
about 0.28 wt % to about 0.33 wt % magnesium (Mg);
greater than 0.5 wt % to about 0.6 wt % iron (Fe);
about 0.21 wt % to about 0.25 wt % manganese (Mn);
greater than 0 wt % to about 0.11 wt % strontium (Sr); and
a remainder wt % of aluminum (Al); and
a maximum wt % of Mg as expressed by:

$$Mg(max)=0.5568\ Exp(-3.128+Fe\ wt\ \%)$$

wherein Mg (max)=maximum wt % of Mg.

2. The aluminum alloy according to claim 1, further comprising greater than 0 wt % to about 0.2 wt % cerium (Ce).

3. The aluminum alloy of claim 2, comprising 0.2 wt % Ce.

4. The aluminum alloy of claim 2, further comprising greater than 0 wt % to about 0.008 wt % B.

5. The aluminum alloy according to claim 1, further comprising about 0.15 wt % to about 0.18 wt % copper (Cu).

6. The aluminum alloy according to claim 5, further comprising greater than 0 wt % to about 0.15 wt % zinc (Zn).

7. The aluminum alloy of claim 6, comprising:
greater than 0 wt % to about 0.15 wt % Cu; and
greater than 0 wt % to about 0.2 wt % Zn.

8. The aluminum alloy of claim 6, wherein the aluminum alloy further comprises a secondary aluminum alloy.

9. The aluminum alloy of claim 1, further comprising greater than 0 wt % to about 0.01 wt % Boron (B).

10. A high pressure die casting, comprising:
about 5.9 to about 7.1 weight percent (wt %) silicon (Si);
about 0.15 wt % to about 0.18 wt % copper (Cu);
about 0.28 wt % to about 0.33 wt % magnesium (Mg);
about 0.43 wt % to about 0.45 wt % iron (Fe);
about 0.21 wt % to about 0.25 wt % manganese (Mn);
about 0.15 wt % zinc (Zn);
greater than 0 wt % to about 0.01 wt % strontium (Sr);
greater than 0 wt % to about 0.2 wt % cerium (Ce);
greater than 0 wt % to about 0.01 wt % Boron (B); and
a remainder wt % of aluminum (Al); and
a maximum wt % of Mg as expressed by:

$$Mg(max)=0.5568Exp(-3.128+Fe\ wt\ \%)$$

wherein Mg (max)=maximum wt % of Mg.

11. The casting of claim 10, further comprising an as-cast yield strength of greater than 130 Megapascals (MPa).

12. The casting of claim 10, further comprising an as-cast ultimate tensile strength of greater than 260 Megapascals (MPa).

13. The casting of claim 10, wherein the high pressure die casting is cast with a secondary aluminum casting alloy.

14. The casting of claim 10, wherein the high pressure die casting includes a length greater than 2 meters, a width greater than 0.8 meter, and a height of about 0.25 meter.

15. The casting of claim 10, further comprising an elongation of greater than about 7.8 percent and less than 11.5 percent.

16. The casting of claim 10, wherein the casting is subjected to age hardening at a temperature between about 150° C. to about 200° C. for about 2 hours; and further comprising substantially free of β-Fe phase.

17. The casting of claim 10, further comprising a yield strength (YS) of between about 135 Megapascals (MPa) and about 145 MPa.

18. The casting of claim 10, further comprising a ultimate tensile strength (UTS) of between about 270 MPa and 280 MPa.

19. A secondary aluminum alloy suitable for high pressure die casting of an ultra-large structure, comprising:
about 4 to about 12 weight percent (wt %) silicon (Si);
greater than about 0.5 wt % to about 0.6 wt % iron (Fe);
about 0.21 wt % to about 0.25 wt % manganese (Mn);
greater than 0 wt % to about 0.01 wt % strontium (Sr);
about 0.15 wt % to about 0.18 wt % copper (Cu);
about 0.15 wt % zinc (Zn); and
a remainder wt % of aluminum (Al); and
a maximum wt % of Mg as expressed by:

$$Mg(max)=0.5568Exp(-3.128+Fe\ wt\ \%)$$

wherein Mg(max)=maximum wt % of Mg; and
wherein the secondary aluminum alloy comprises a recycled aluminum alloy; and
wherein the ultra-large structure includes a width of at least 0.8 meter (m), a length of at least 1 m, and a height of at least 0.25 m.

20. The secondary aluminum alloy of claim 19, further comprising a Sludge Factor (SF) of greater than about 0.8 and less than about 2.0 as defined by the equation: SF=(1×wt % Fe)+(2×wt % Mn)+(3×wt % Cr).

* * * * *